United States Patent [19]

Rawson

[11] 4,128,609

[45] Dec. 5, 1978

[54] METHOD OF ATTACHING HEELS TO SHOES

[75] Inventor: Francis F. H. Rawson, Loughborough, England

[73] Assignee: USM Corporation, Farmington, Conn.

[21] Appl. No.: 834,989

[22] Filed: Sep. 20, 1977

[30] Foreign Application Priority Data

Jan. 26, 1977 [GB] United Kingdom ..... 3052/77

[51] Int. Cl.[2] ..... B29D 3/00; B29F 5/00

[52] U.S. Cl. ..... 264/23; 29/432; 227/131; 227/156; 264/244; 264/248; 264/249; 264/273

[58] Field of Search ..... 264/23, 244, 248, 249, 264/271, 273; 156/73.1, 91, 92; 29/432; 12/43, 147 R; 425/119, 129 S, 130, 174.4; 227/156, 131

[56] References Cited

U.S. PATENT DOCUMENTS

| | | | |
|---|---|---|---|
| 2,261,734 | 11/1941 | Ricks et al. | 12/147 R |
| 3,184,353 | 5/1965 | Balamuth et al. | 156/73.1 |
| 3,251,146 | 5/1966 | Slosberg | 36/34 A |

*Primary Examiner*—Willard E. Hoag

*Attorney, Agent, or Firm*—Carl E. Johnson; Richard B. Megley; Vincent A. White

[57] ABSTRACT

A plastic heel is attached by inserting through an insole of a shoe a fastener, and vibrating the fastener at ultrasonic frequency to cause its shank to melt the plastic and become embedded in the heel. The fastener may be a staple with wide legs having holes therein. The shank of the shoe may be bridged by the staple for added attachment strength. Since less work penetration is needed than in nail-attaching of heels, advantage is gained especially in securing sharply tapering or so-called "stiletto" heels.

8 Claims, 3 Drawing Figures

24
40
28
38
34
22
26
32
30
36
26
42
20
44
S
I
F
18
H
16
12
14
14
10

METHOD OF ATTACHING HEELS TO SHOES

BACKGROUND OF THE INVENTION

This invention is concerned with improvements in or relating to the manufacture of shoes and is especially concerned with methods of attaching heels to shoes.

The term "shoe" where used herein is to be understood as referring to outer footwear generally whether complete or in the course of manufacture.

It is a common practice in the shoe industry to attach heels by means of nails which are hammered through the insole of the shoe into the heel. In most cases, if four or six nails are used, adequate attachment is obtained whether the heel is made of wood or of thermoplastic material. However, in the case of sharply tapering heels e.g. "stiletto" heels, which are generally made of thermoplastic material since wood is not sufficiently strong for this purpose, it may be very difficult to insert sufficient nails because of the limited fastening area available. The area available is limited by the taper of the heel which reduces the locality where there is sufficient depth of material for a nail to be inserted. (It is generally recommended that a heel-attaching nail be inserted to a depth of at least ten millimeters.) The attachment area available may well also be reduced by the presence of a shank in the shoe. Also, in the case of very high heels, whether or not they are of the "stiletto" type, it is difficult to achieve sufficiently strong attachment.

SUMMARY OF THE INVENTION

It is one of the various objects of the present invention to provide an improved method of attaching a heel which comprises thermoplastic material to a shoe, which method enables strong heel attachment to be achieved by causing a fastener to be embedded in the thermoplastic material of the heel.

In the illustrative method hereinafter disclosed, a fastener is used which is in the form of a staple having a head or bridging portion and a shank portion formed by two legs. However, a method according to the invention may be carried out using fasteners in other forms provided that the fastener has a head portion and a shank portion.

In carrying out the illustrative method, a heel to be attached is positioned in a recess in a pad, so that an upper or attaching surface of the heel is substantially flush with an upper surface of the pad, and a shoe to which the heel is to be attached is placed on top of the pad so that the heel is positioned against a heel seat portion of the shoe. The shoe to which the heel is to be attached comprises an insole and usually a metal shank, the insole preferably having two slots cut therethrough, one on each side of the shank. The fastener used in the illustrative method is inserted into the shoe so that ends of the legs of the fastener pass through the slots in the insole and engage thermoplastic material of the heel, and the head portion of the fastener overlies the portion of the insole which lies between the slots. The fastener may be inserted as aforesaid by hand.

In a method in accordance with the invention but differing from the mentioned illustrative method, the shoe to which a heel is to be attached may be inverted and the heel positioned on top of the shoe so that it is positioned against the heel seat portion of the shoe. The heel is then clamped in position and the fastener inserted from beneath the shoe. Furthermore, the insole may not be provided with pre-cut slots but instead the fastener may itself be used to form the slots by being forced through the insole as it is inserted. If this is done, the legs of the fastener may be provided with sharp lower (i.e. "lower" when the fastener head is uppermost) edges or the legs may narrow towards their lower edges. Another alternative possibility is that the legs may be serrated along their lower edges.

After the fastener has been inserted in the illustrative method, the fastener is caused to vibrate at an ultrasonic frequency by engaging the head portion of the fastener with a fastener-engaging member connected to an ultrasonic transducer. The transducer, used in the illustrative method, is of the magnetostrictive vibrator type and is preferably arranged to create mechanical vibrations at a frequency of approximately 20 kiloHertz and an amplitude of approximately twenty-five microns. However, in a method according to the invention, a transducer of another suitable type may be used, e.g. a transducer of the piezo-electric type. Also the transducer may operate at another suitable frequency and/or amplitude.

The vibration of the fastener in the illustrative method causes the thermoplastic material of the heel adjacent the legs of the fastener to melt or soften. The fastener is pressed into the heel by means of a piston and cylinder arrangement which presses the transducer and the fastener-engaging member heightwise of the heel. The legs of the fastener then enter the thermoplastic material of the heel, the immediately adjacent melted or softened thermoplastic material flowing around the legs. The legs thus become embedded in the thermoplastic material of the heel.

In a method in accordance with the invention wherein the insole of the shoe does not have pre-cut slots and the fastener is to be forced through the insole to form the slots, the fastener may be vibrated at an ultrasonic frequency to aid in cutting through the insole. If the insole is made of thermoplastic material, the fastener may be vibrated to melt its way through the insole.

Although practice of the illustrative method inserts a single fastener, in a method according to the invention, a plurality of fasteners may similarly be inserted. Such fasteners may, or may not, all be in the form of staples.

The present invention provides, in one of its several aspects, a method of attaching a heel which comprises thermoplastic material to a shoe, the method comprising positioning the heel against a heel seat portion of a shoe, inserting a fastener having a head portion and a shank portion so that the shank portion of the fastener passes through an insole of the shoe and engages the thermoplastic material of the heel and the head portion of the fastener overlies a portion of the insole, causing the fastener to vibrate at an ultrasonic frequency so that the thermoplastic material of the heel adjacent the shank portion is melted or softened, and pressing the fastener into the heel so that the shank portion enters the thermoplastic material, the melted or softened thermoplastic material flowing around the shank portion, and becomes embedded therein.

It is preferred that, in a method as set out in the last preceding paragraph, the fastener is in the form of a staple, the shank portion of the fastener comprising two legs each of which has at least one hole extending transversely therethrough into which the softened or molten thermoplastic material can flow prior to hardening.

BRIEF DESCRIPTION OF DRAWINGS

The above and other of the various objects and the several aspects of the invention will become more clear from the following detailed description, to be read with reference to the accompanying drawings, of the illustrative method aforementioned. It is to be understood that the illustrative method has been selected for description by way of example and not by way of limitation.

In the drawings.

DESCRIPTION OF PREFERRED EMBODIMENT

Figure 1:
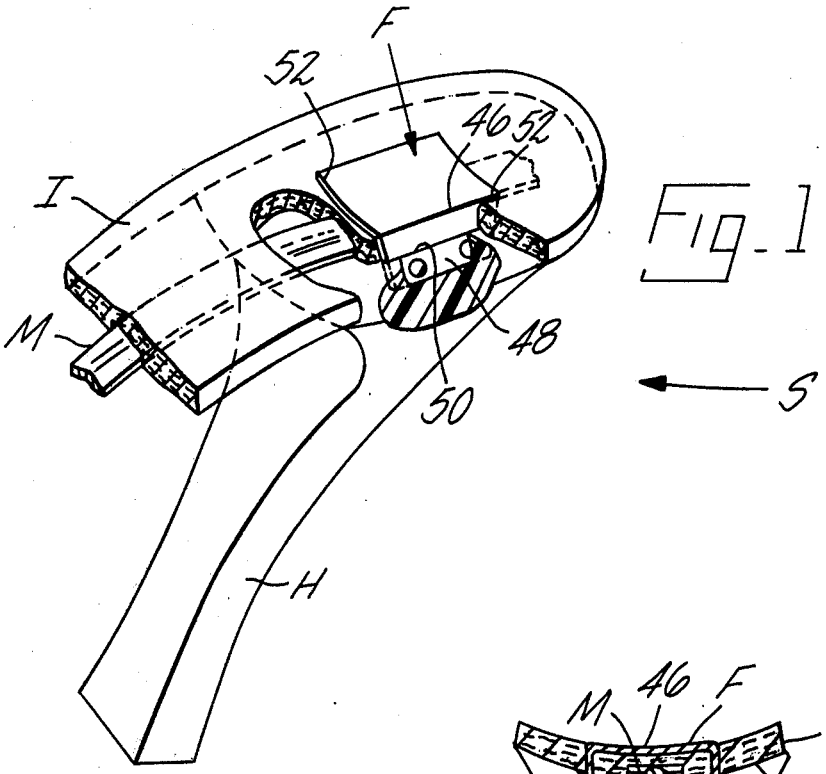
FIG. 1 is a perspective view, with portions broken away, of the heel end of a shoe to which a heel has been attached by the illustrative method.
Figure 2:
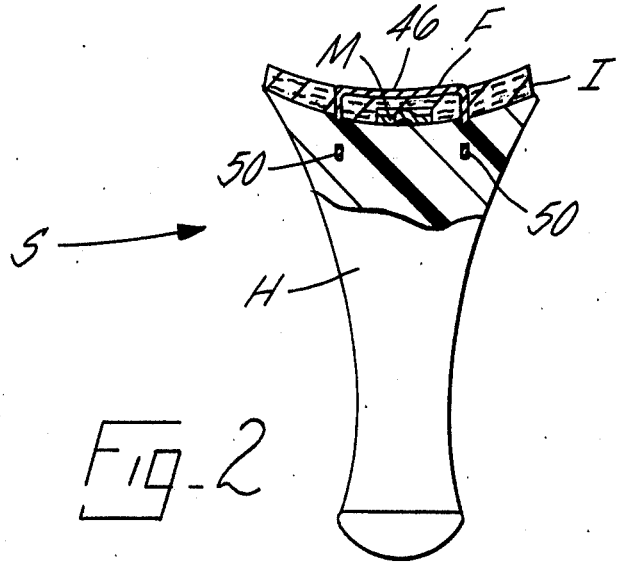
FIG. 2 is a sectional view taken transversely of the shoe through the insole and heel portion of the shoe shown in FIG. 1.

FIGS. 1 and 2 show a portion of a shoe S, the shoe upper having been omitted for the sake of clarity, after it has had a heel H attached thereto by means of the illustrative method. The shoe S comprises an insole I and a metal shank M. The heel H is of the sharply tapering or "stiletto" type although the illustrative method may be used with heels which are not of this type provided they comprise thermoplastic material. The heel H may, for example, be made of polyethylene or polystyrene and may, if desired, incorporate metal stiffeners. As long as the central portion of the shoe-engaging portion of the heel is made of thermoplastic material, the illustrative method can be used to attach the heel.

Figure 3:
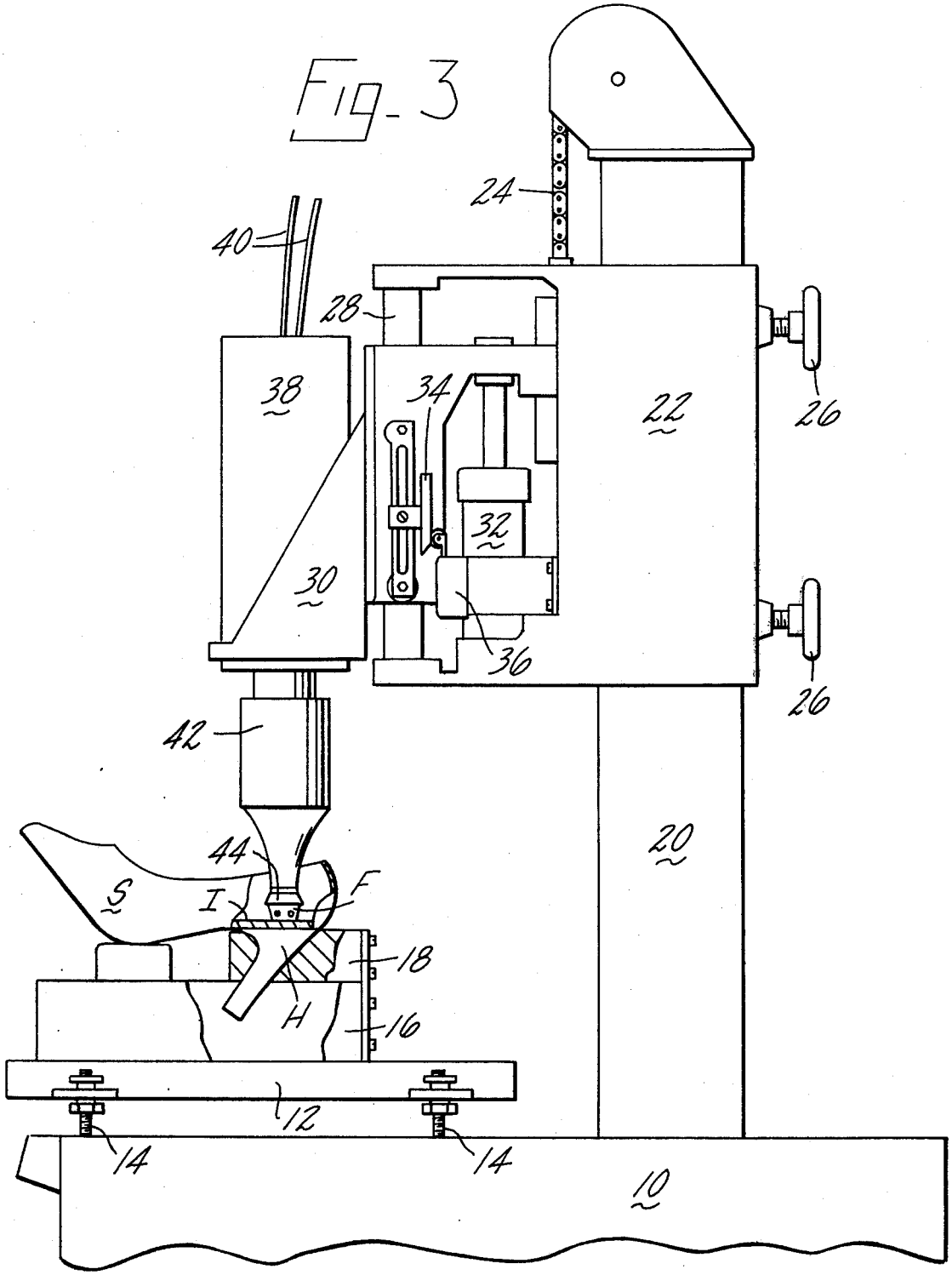
FIG. 3 is a side elevational view of an apparatus for use in carrying out the illustrative method.

The apparatus shown in FIG. 3 comprises a frame 10 which supports a table 12 which can be tilted about an axis extending widthwise of a shoe by means of screws 14. The table 12 is provided with a shoe support 16 which includes a pad 18. In operation of the apparatus, the heel H is preferably inserted into a recess in the pad 18 so that the upper surface of the heel H is substantially flush with the upper surface of the pad 18. Next, the shoe S is positioned on the pad 18 so that the heel H is against a heel seat portion of the shoe S. The screws 14 are used to suitably tilt the table 12 and therefore the support 16, usually until the portion of the insole I which engages the upper portion of the heel H is approximately horizontal.

The apparatus shown in FIG. 3 also comprises a vertical support column 20 on which a support 22 is slidable. The support 22 is connected to a counterweight (not shown) by a chain 24, so that it can readily be moved on the column 20, and can be locked in selected heightwise position by means of two lock screws 26. The support 22 carries a vertical bar 28 on which a carrier 30 is slidable under the influence of a pneumatic piston and cylinder arrangement 32 carried by the support 22. A cam 34 on the carrier 30 is arranged to operate a microswitch 36 mounted on the support 22. The carrier 30 carries a transducer 38 which is of the magnetostrictive vibrator type and is arranged, upon receipt of electrical energy from a H.F. generator (not shown), which is connected to the transducer 38 by leads 40, to create mechanical vibrations at a frequency of approximately twenty kiloHertz. The transducer 38 is connected to a fastener-engaging and driving member 44 by means of a horn 42 which serves to concentrate the vibrations on to the member 44. The member 44 may be an integral tip of the horn 42 or may be interchangeably connected. In the operation of the apparatus, the piston and cylinder arrangement 32 is arranged to operate to urge the transducer 38 and the horn 42 downwards so that the member 44 can press a fastener F inserted, or to be inserted, in the shoe S downwards into the heel H.

The apparatus shown in FIG. 3 is used in the illustrative method which will now be described. A preferred fastener F is used in the illustrative method which has a head portion and a shank portion and is in the form of a staple made from metal strip so that it has wide legs, i.e. considerably wider that the diameter of usual wire staples.

The fastener F is shown in FIGS. 1 and 2 and comprises a head portion 46, and two legs 48 which together form a shank portion. Each of the legs 48 has, for instance, two circular holes 50 extending transversely therethrough and narrows towards the lower or leading end thereof. The head portion 46 preferably is slightly concave when seen from above so that, when in position in the shoe S, it will conform to the heel of a wearer thereby giving greater wearing comfort. The legs 48 may each desirably extend approximately 12 millimeters from the head portion 48 and the holes 50 are centered, for instance, approximately 5 millimeters from the leading end of the leg 48, the holes 50 being approximately three-and-one-half millimeters in diameter, for example.

In the illustrative method, the heel H and the shoe S are positioned on the support 16, as described above, and the fastener F is inserted into the shoe S so that the legs 48 each enter one of two pre-cut slots 52 through the insole I of the shoe S (FIG. 1). The ends of the legs 48 thus pass through the insole I and engage the thermoplastic material of the heel H. When the fastener F has been partly inserted, its head portion 46 overlies the portion of the insole I which is between the slots 52. The slots 52 are one on each side of the shank M of the shoe S so that the head portion 46 bridges the shank M and the legs 48 are one on each side of the shank M.

When the fastener F has thus been inserted, the piston and cylinder arrangement 32 is operated so that the member 44 moves downwards and comes into engagement with the head portion 46 of the fastener F. When this occurs, the cam 34 operates the microswitch 36 (see FIG. 3) which causes the transducer 38 to begin to create ultrasonic vibrations. The horn 42 and the member 44 transmit the vibrations to the fastener F which is caused to vibrate preferably at an ultrasonic frequency of approximately 20 kiloHertz and an amplitude of approximately 25 microns. The vibration of the fastener F causes the thermoplastic material of the heel H adjacent the legs 48 to melt or soften and continued driving operation of the piston and cylinder arrangement 32 maintains the member 44 in contact with the head portion 46 and presses the legs 48 into the thermoplastic material of the heel H. The legs 48 enter the thermoplastic material endwise, the melted thermoplastic material flowing around the legs 48 and entering the holes 50. Operation of the piston and cylinder arrangement 32 and of the transducer 38 continues at least until the head portion 46 of the fastener F engages the insole I and thereupon the operation of the piston and cylinder arrangement 32 is reversed lifting the member 44 away from the fastener F and switching off the transducer 38.

Upon cooling of the melted thermoplastic heel material, the legs 48 are embedded in the heel H giving strong anchoring attachment of the heel H to the shoe S. The thermoplastic material in the holes 50 would require to be sheared-off to remove the heel H from the fastener F, and to remove the fastener F from the remainder of the shoe S would be very difficult since the fastener F not only bridges a portion of the insole I but preferably also the shank M.

It is found that, by using the illustrative method, heels can be more easily and strongly attached than by some prior methods of heel attachment. Strong heel attachment can be achieved even when only some 5 millimeters of the legs 48 are embedded in the heel H. This compares favorably with the usually recommended minimum of ten millimeters for conventional heel attachment by nails. The additional strength attained by the illustrative method is believed to be due to the thermoplastic material of the heel being caused to flow around an/or through the fastener and not impact shattered as it would be in the case of conventional nailing.

Having thus described my invention, what I claim as new and desire to secure as Letters Patent of the United States is:

1. A method of attaching a thermoplastic heel to a shoe having an insole by means of a fastener having a head portion and a shank portion, the method comprising positioning the heel against the heel seat portion of the shoe, inserting the shank portion through the insole and into the thermoplastic material of the heel with the head portion overlying the insole, vibrating the fastener at an ultrasonic frequency to at least soften the material of the heel adjacent to the shank portion, and pressing the fastener into the heel to embed the shank portion in the material while it is at least softened said fastener having its shank portion formed with at least one hole extending transversely therethrough into which the softened heel material flows.

2. The method of claim 1 wherein the fastener is at least one staple.

3. The method of claim 1 wherein the vibration of the fastener is approximately at a frequency of 20 kiloHertz and an amplitude of about 25 microns.

4. The method of claim 1 wherein the vibration of the fastener also facilitates its penetration through the insole.

5. The method of claim 1 wherein the fastener is formed U-shape from a metal strip and its shank portion includes a pair of tapering wide legs spaced to straddle a shank of the shoe when driven into the thermoplastic material.

6. The method of claim 5 wherein each leg has at least one hole formed therein for receiving the melted or softened thermoplastic material.

7. The method of claim 1 wherein the fastener is of staple-shape and the head thereof is slightly concave to bridge the shoe shank and correspond to the heel of a wearer of the shoe.

8. The method of claim 7 wherein the fastener is formed of a metal strip and has a pair of tapering legs each of which has at least one transverse hole therein disposed to receive thermoplastic when embedded in the heel.

* * * * *